US005454468A

United States Patent [19]

Chou et al.

[11] Patent Number: 5,454,468

[45] Date of Patent: Oct. 3, 1995

[54] WAFER CONTAINER

[75] Inventors: Fong-Ru Chou; Kan-Peng Hsu, both of Hsinchu, Taiwan

[73] Assignee: United Microelectronics Corp., Hsinchu, Taiwan

[21] Appl. No.: 212,562

[22] Filed: Mar. 11, 1994

[51] Int. Cl.[6] ..... B65D 85/02

[52] U.S. Cl. ..... 206/303; 206/445; 206/499; 206/710; 206/718

[58] Field of Search ..... 206/328, 303, 206/445, 499, 804, 817; 220/409

[56] References Cited

U.S. PATENT DOCUMENTS

| | | | |
|---|---|---|---|
| 3,362,530 | 1/1968 | Johnson | 206/804 |
| 3,363,794 | 1/1968 | Dearing | 206/804 |
| 3,439,827 | 4/1969 | Marland | 206/804 |
| 3,547,303 | 12/1970 | Mascia | 206/804 |
| 4,765,482 | 8/1988 | Delia | 206/804 |
| 4,787,508 | 11/1988 | Wu et al. | 206/445 |
| 5,037,010 | 8/1991 | Dikstein | 206/804 |

*Primary Examiner*—David T. Fidei
*Attorney, Agent, or Firm*—Ladas & Parry

[57] ABSTRACT

A wafer container for conveying silicon wafers, which can be readily re-used after transportation. The cover of the container has recesses to stress the wafers to prevent shaking. The container can be piled up and are easy to open.

8 Claims, 5 Drawing Sheets

WAFER CONTAINER

FIELD OF THE INVENTION

The present invention relates to a container for silicon wafers, especially to a wafer container having an inner case for storing wafers made of silicon or other semiconductor materials.

BACKGROUND OF THE INVENTION

Please refer to FIG. 1, a perspective view of a conventional wafer storing container such as that disclosed in U.S. Pat. No. 4,787,508. The conventional wafer container comprises a main case 10 and a covering means 20. The main case 10 is tube-like for storing wafers (not shown), having a close end 110, and an open end 120. Several slots 130 are provided at the wall of the main case 10 from its open end 120 along its axis, so that wafers can be clipped and taken out. Threads 140 are provided on the outer periphery of the main case 10 near its close end 110.

The covering means 20 is substantially tube-like, having a close end 210 and an open end 220, for being sleeved on the main case 10. The inner periphery of the covering means 20 has threads (not shown) to be engaged with threads 140, for sealing the entire container. A circular recess 230 is formed on the close end 210. A round protrusion 240 is provided within the recess 230 to be turned to open the covering means 20.

There are some deficiencies in the conventional wafer container 1. Because wafers are not tightly secured in the container, wafers may be damaged from shaking in transportation. Furthermore, it needs additional efforts to fasten the containers. Besides, when the circular recess 230 is too narrow, a user can hardly insert his fingers into the recess 230 to turn the protrusion 240. On the other hand, if the circular recess 230 is widened to receive fingers, the outer periphery of the protrusion 240 will be reduced, therefore increases the force needed to turn the covering means 20. Another deficiency is that the container can not be re-used before all wafers in the container are taken out, which increases the cost in maintaining a lot of containers in factories.

SUMMARY OF THE INVENTION

The object of the present invention is to provide a wafer container which is easy to open.

Another object of the present invention is to provide a wafer container which is re-usable.

The above objects are fulfilled by providing a wafer container, which comprises: (1) a tube-like shell having a close end and an open end; (2) a cover to fit with the shell; (3) a tube-like inner case with a diameter slightly smaller than the shell to fit therein, having a close end and an open end for storing wafers, the inner case having at least one slot provided along its longitudinal axis from the open end of the inner case, the open end of the inner case protruding from the open end of the shell when the inner case is inserted into the shell.

BRIEF DESCRIPTION OF THE DRAWING

The present invention will become more fully understood from the detailed description given hereinafter with reference to and the accompanying drawings which are given by way of illustration only, and thus are not limitative of the present invention and wherein.

DETAILED DESCRIPTION OF THE PREFERRED EMBODIMENT

Figure 1:
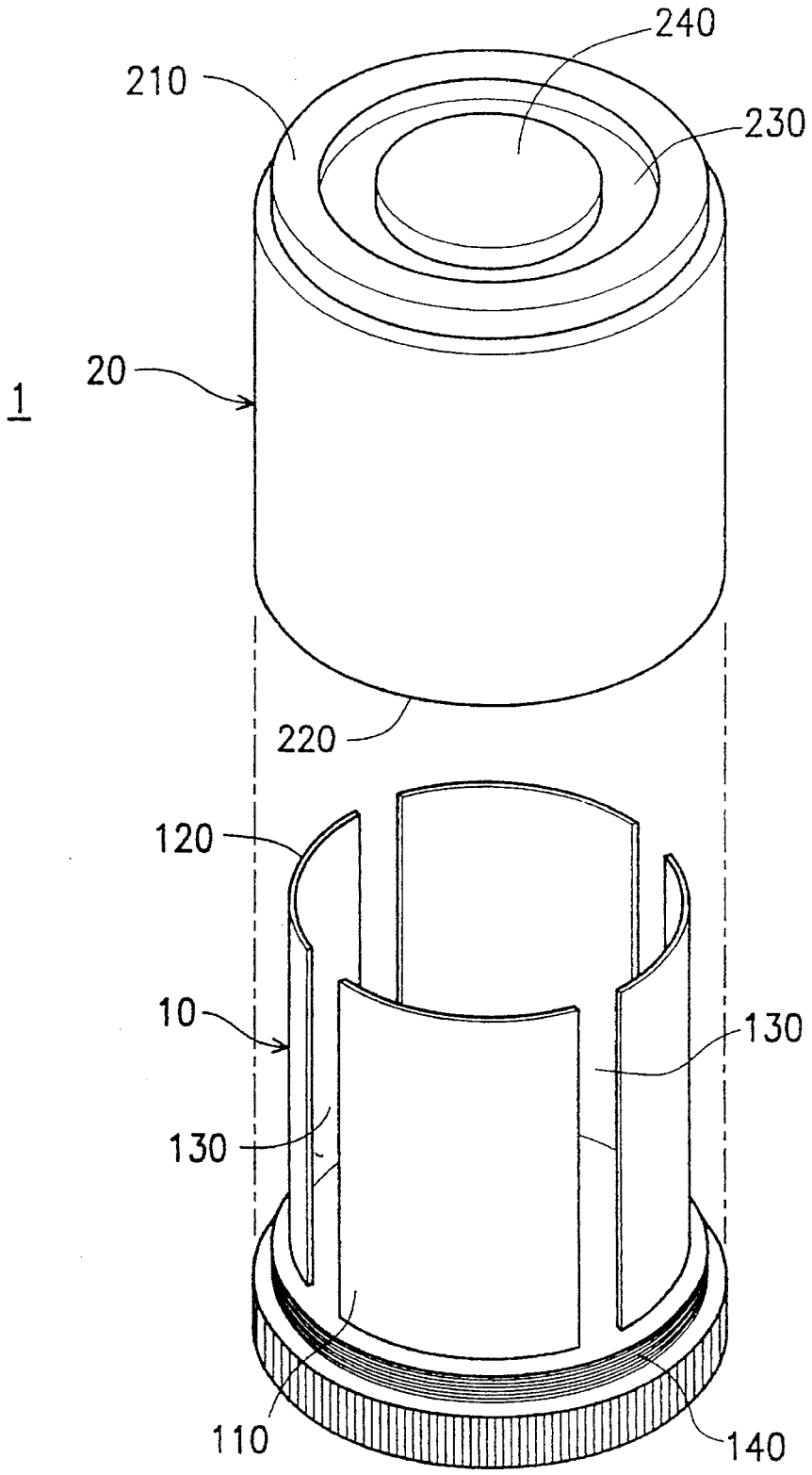
FIG. 1 (PRIOR ART)
FIG. 1 is a exploded perspective view showing a conventional wafer container.
Figure 2:
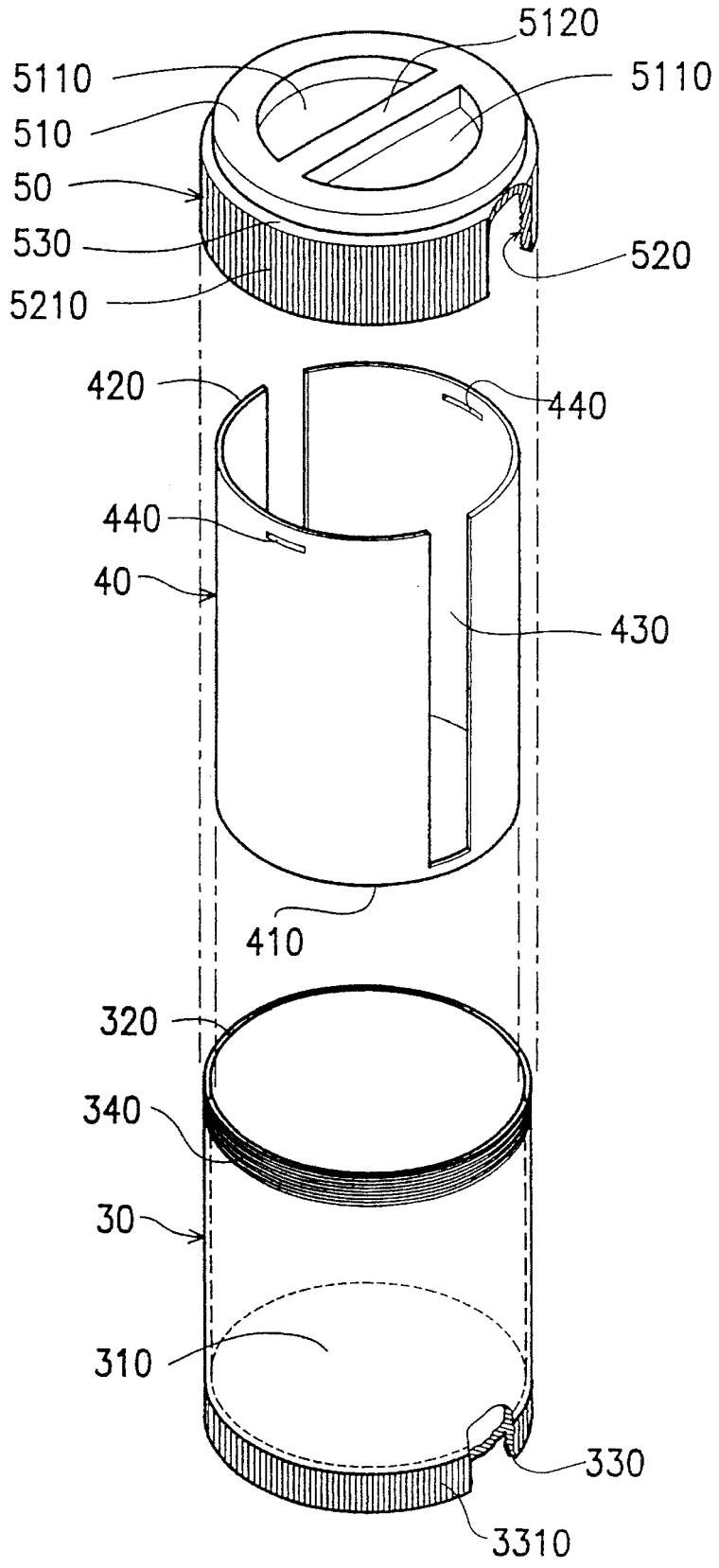
FIG. 2 is a exploded perspective view showing a wafer holder according to the present invention.

Referring to FIGS. 2 to 5, a wafer container 2 according to the present invention comprises a shell 30, an inner case 40, and a cover 50. These components will be further discussed hereinbelow.

Shell 30 is substantially tube-like. The preferred cross section of the shell 30 is a circle. However, other shapes like tetragon, hexagon, octagon, etc. can also be used. One end of the shell 30 is a closed end 310. Another end of the shell 30 is an open end 320. The closed end 310 has a ridge portion 330 extended from the close end 310. The outer periphery of the ridge portion 330 is provided with grooves 3310. The open end 320 has threads 340 provided on its outer periphery.

Figure 3:
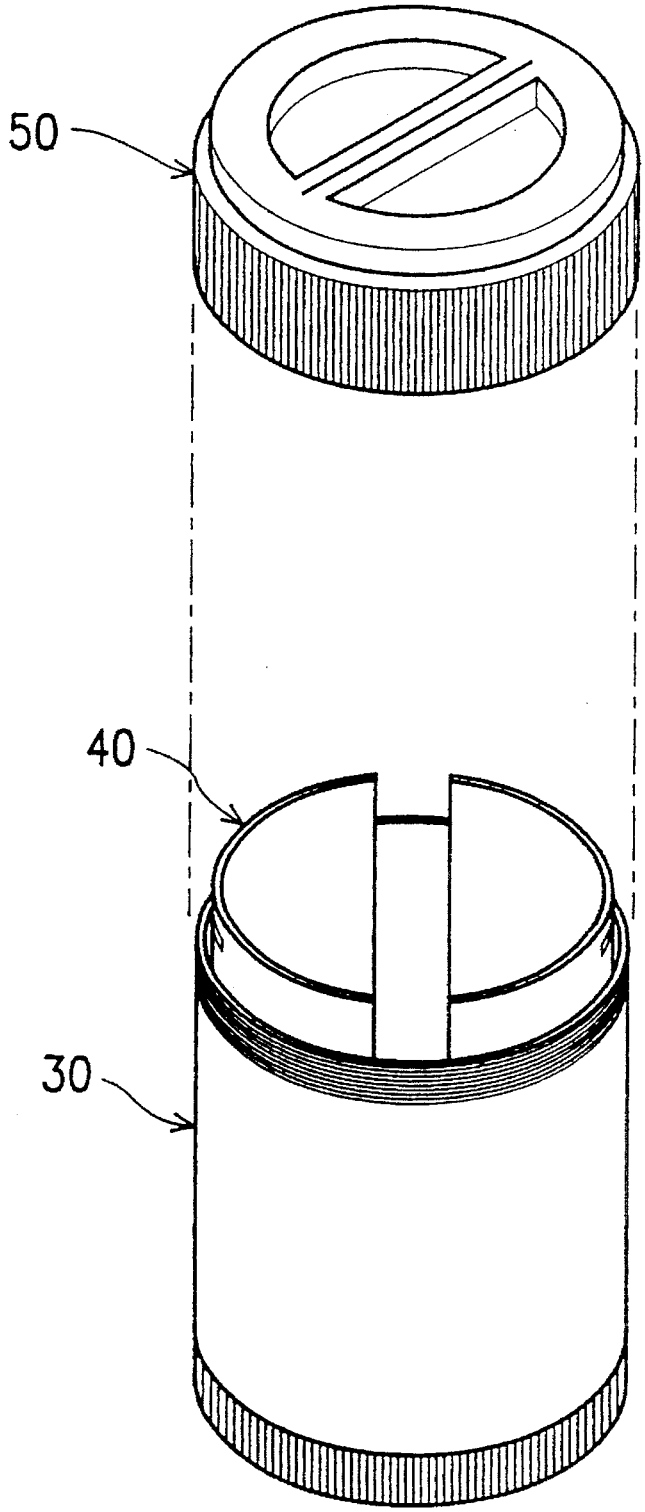
FIG. 3 is a perspective view showing the wafer holder shown in FIG. 2 where an inner case is inserted into an outer case.
Figure 4:
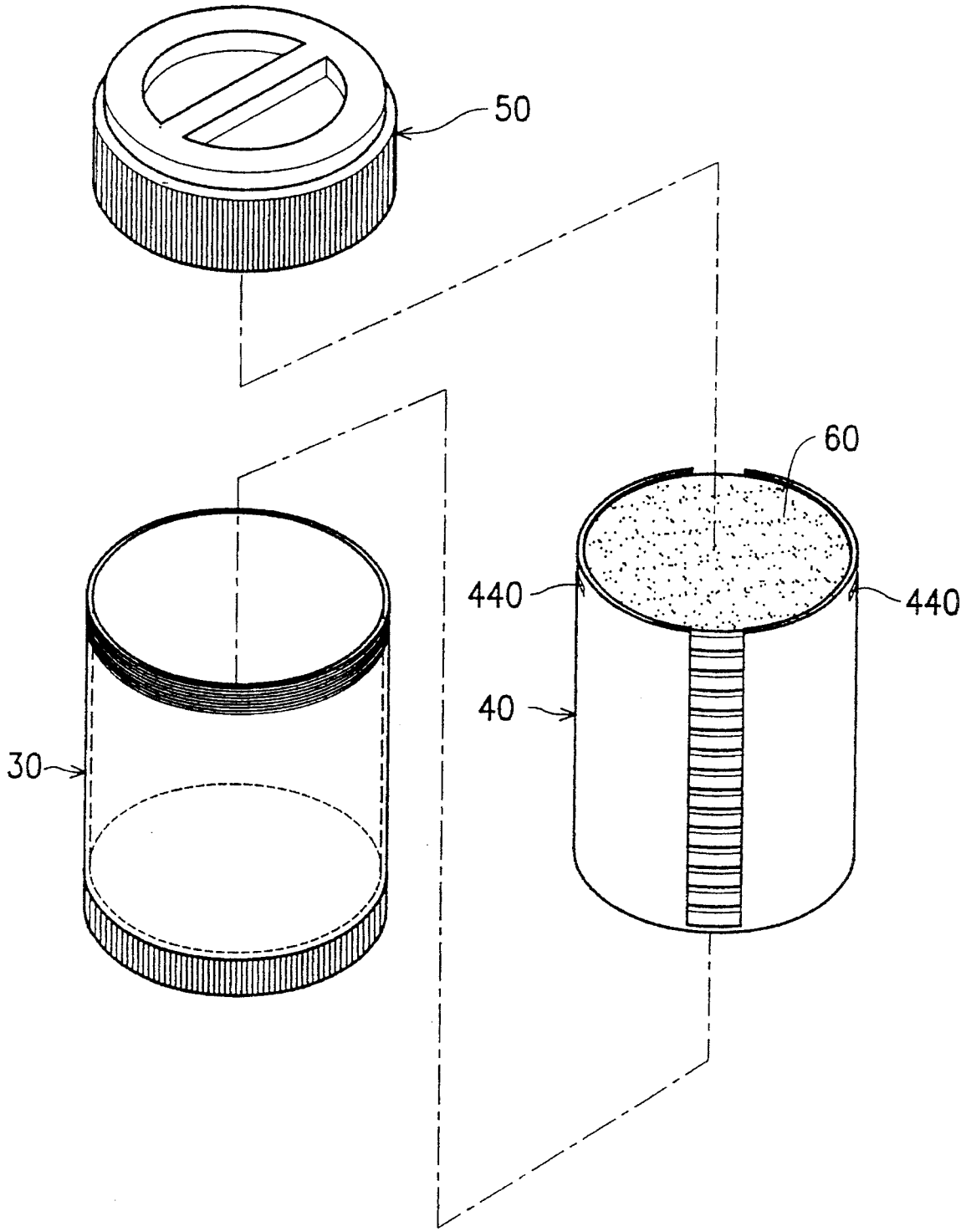
FIG. 4 is a perspective view showing the wafer holder shown in FIG. 2 wherein the inner case containing wafers is separated from the outer case.

The inner case 40 is tube-like in the same shape as that of the shell 30, having a diameter slightly smaller than that of the shell 30, to store wafers 60 therein. The inner case 40 has a closed end 410 and an open end 420. Two slots 430 are provided on the wall of the inner case 40 along its longitudinal axis from the open end 420. Inner case 40 can be inserted into the shell 30, with its open end 420 protruding from the open end 320 of the shell 30 as shown in FIG. 3. Pull-out holes 440 are provided at the open end 420 of the inner case 40, so that the inner case 40 can be extracted from the shell 30 as shown in FIG. 4.

Figure 5:
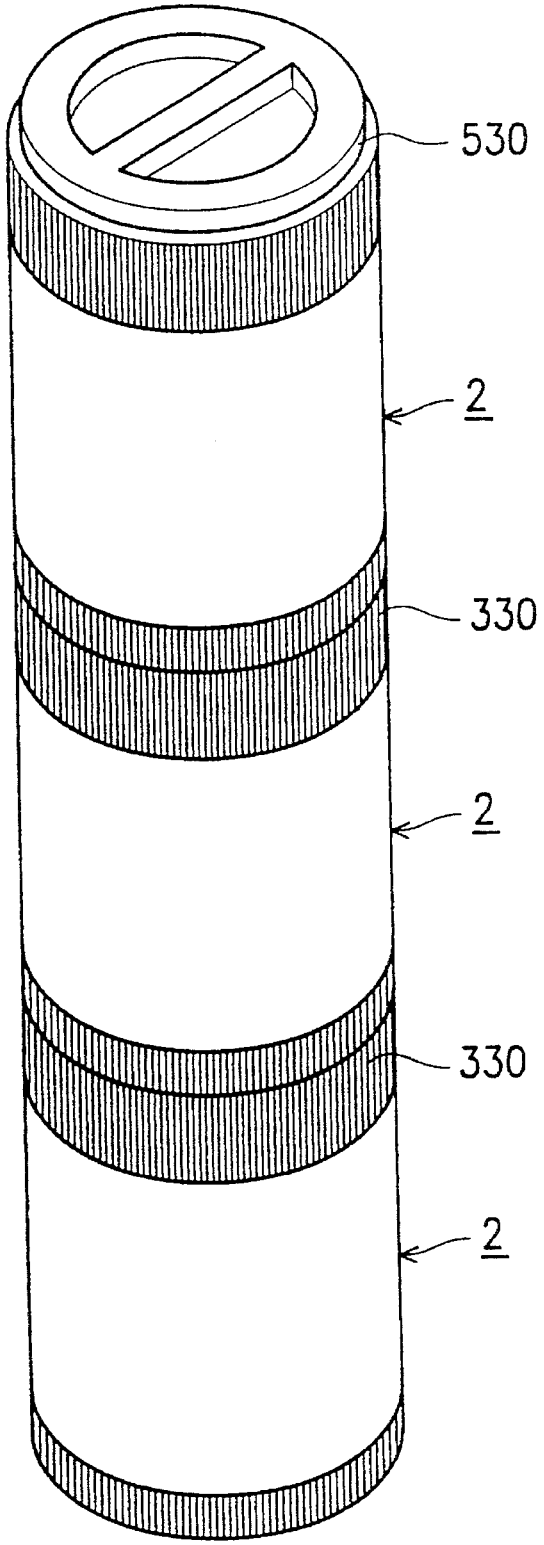
FIG. 5 is a perspective view showing several stacked wafer holders.

Cover 50 is in the same shape and diameter as that of the shell 30 to fit on the shell 30. Threads 520 (not shown) are provided at the inner periphery of the edge of cover 50 to engage with the threads 340 of the shell 30. Terrace 510 extends from the upper side of the cover 50, and forms a tread 530 at the outer periphery of the terrace 510. A pair of recesses 5110 is provided on the terrace 510, to apply a pressure on wafers 60 stored in the inner case 40, so as to prevent wafers 60 from shaking. It is apparent that the recess could be only one or more. Shoulder 530 can be engaged with the ridge portion 330 of the shell 30, so that a plurality of wafer containers 2 can be piled up for easier storage and transportation as shown in FIG. 5. Snicks 5210 are provided on the outer periphery of the edge of the cover 50, so that a user can grab the container 2 by grooves 5210 and grooves 3310, then turn the cover 50 to open the container 2 easily.

As stated above, the wafer container according to the present invention has recesses provided on the cover, so that the shake of wafers can be prevented. Furthermore, because snicks are provided on the cover and shell, users can open the container easily without much effort. Additionally, the inner case containing all wafers can be extracted from the container, so that the shell and cover can be readily re-used after transportation. Since a plurality of containers can be piled up, the containers are easy to transport.

While the invention has been described by way of examples and in terms of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A wafer container comprising:

a tubular shell having a closed end and an open end;

a cover adapted to fit over the shell, said cover including at least one recess for stressing wafers in the container;

a tubular inner case, with a diameter slightly smaller than the shell to fit therein, having a closed end and an open end for storing wafers, the inner case having at least one slot provided along a longitudinal axis extending from the open end of the inner case, the open end of the inner case protruding above the open end of the shell when the inner case is inserted into the shell;

wherein the open end of the inner case protruding above the open end of the shell has at least one pull-out hole.

2. A wafer container comprising:

a tubular shell having a closed end and an open end;

a cover adapted to fit over the shell;

a tubular inner case, with a diameter slightly smaller than the shell to fit therein, having a closed end and an open end for storing wafers, the inner case having at least one slot provided along a longitudinal axis extending from the open end of the inner case, the open end of the inner case protruding above the open end of the shell when the inner case is inserted into the shell;

wherein the open end of the inner case protruding above the open end of the shell has at least one pull-out hole.

3. A wafer container as claimed in claim 1, wherein the shell and the cover have grooves provided on their outer peripheries.

4. A wafer container as claimed in claim 3, wherein the shell has a ridge portion provided under the closed end of the shell along an outer periphery, and the cover has a shoulder formed along an outer periphery to fit with the ridge portion of the shell.

5. A wafer container as claimed in claim 1, wherein the shell has a ridge portion provided under the closed end of the shell along an outer periphery, and the cover has a shoulder formed along an outer periphery to fit with the ridge portion of the shell.

6. A wafer container as claimed in claim 2, wherein the shell and the cover have grooves provided on their outer peripheries.

7. A wafer container as claimed in claim 6, wherein the shell has a ridge portion provided under the closed end of the shell along an outer periphery, and the cover has a shoulder formed along an outer periphery to fit with the ridge portion of the shell.

8. A wafer container as claimed in claim 2, wherein the shell has a ridge portion provided under the closed end of the shell along an outer periphery, and the cover has a shoulder formed along an outer periphery to fit with the ridge portion of the shell.

* * * * *